United States Patent [19]

Masuda et al.

[11] 4,159,687

[45] Jul. 3, 1979

[54] AUTOMATIC GUIDING METHOD FOR WORKPIECE IN SEWING MACHINE

[75] Inventors: Koji Masuda, Sagamihara; Nobuyoshi Haniuda, Yokohama, both of Japan

[73] Assignee: Kayabe Industry Co., Ltd., Tokyo, Japan

[21] Appl. No.: 772,340

[22] Filed: Feb. 25, 1977

[30] Foreign Application Priority Data

| | | | |
|---|---|---|---|
| Feb. 27, 1976 | [JP] | Japan | 51-20924 |
| Apr. 5, 1976 | [JP] | Japan | 51-37904 |
| Apr. 5, 1976 | [JP] | Japan | 51-37905 |

[51] Int. Cl.[2] ..... D05B 21/00; D05B 35/10

[52] U.S. Cl. ..... 112/262.3; 112/121.12; 112/153; 112/306

[58] Field of Search ..... 112/262, 153, 204, 205, 112/121.12, 121.11

[56] References Cited

U.S. PATENT DOCUMENTS

| | | | |
|---|---|---|---|
| 3,609,373 | 9/1971 | Desai et.al. | 112/205 X |
| 3,722,441 | 3/1973 | Kitchener et al. | 112/205 |
| 3,889,614 | 6/1975 | Nicolay et al. | 112/153 |
| 3,903,820 | 9/1975 | Kleinschmidt et al. | 112/153 |

FOREIGN PATENT DOCUMENTS

| | | | |
|---|---|---|---|
| 641966 | 4/1964 | Belgium | 112/153 |

*Primary Examiner*—H. Hampton Hunter

*Attorney, Agent, or Firm*—Wenderoth, Lind & Ponack

[57] ABSTRACT

An automatic guiding method and device for work piece in a sewing machine, in which whether or not the side edge of a work piece is in a proper position or a control position, or biased in a direction away from the control position, is detected upstream of a stitching point. When the side edge of a work piece is biased in a direction away from the control position, the work piece is drawn back to the control position. The side edge of the work piece is restricted from being biased past the control position beyond an allowable amount.

3 Claims, 43 Drawing Figures

AUTOMATIC GUIDING METHOD FOR WORKPIECE IN SEWING MACHINE

BACKGROUND OF THE INVENTION

1. Field of the Invention

This invention relates to an automatic guiding method and a device for a work piece in a sewing machine, which automatically adjusts the side edge of a work piece being sewn during the sewing operation of the machine so as to maintain the side edges in a proper position, whereby a work piece may be stitched at a given distance from the side edge of the work piece.

2. Description of the Prior Art

An attempt has been made, as disclosed in Japanese Pat. No. 430726 (Japanese Patent Publication No. 7688/64), to position a detecting means at a given transverse distance from the feeding line of a work piece, which passes through a stitching point, but upstream of the stitching point. In addition, a feeding control device for a work piece is positioned further upstream of the detecting means so as to be rotatable about an axis running substantially parallel with the aforesaid feeding line, and includes a single rotary wheel adapted to be driven by a servomotor the normal and reverse rotations of which are controlled by the aforesaid detecting means. Thus, the aforesaid detecting means detects whether or not the side edge of a work piece being fed in a given direction during the sewing operation of the machine is maintained in a proper position or biased in either direction from the feeding direction, after which the rotary wheel in the aforesaid feeding control means is rotated according to a deviation signal from the detecting means so as to bring the side edge of the work piece back to a proper position. To achieve this the rotary wheel maintains its contact with a work piece.

Another attempt has also been made, in which in place of a feeding control device for a work piece, a mechanical stop member is provided in a predetermined proper position, and through which a work piece is to pass, but upstream of the stitching point of a work piece; and a resisting means is positioned upstream of the stop member but opposite to the stop member with respect to the feeding line of the work piece, which passes through the stitching point of the work piece, so that the resisting means presses the surface of the work piece, whereby during the sewing operation of the machine, the work piece has imparted thereto a moment of rotation in the counterclockwise direction about the stitching point of the work piece at all times so that the side edge of the work piece will maintain contact with the stop member for keeping the side edge in a proper position.

However, these attempts suffer from the following shortcomings:

Firstly, in the former attempt, if the wheel is small the peripheral speed of the rotary wheel in the normal and reverse directions must be increased for controlling the side edge. In addition, an increase in the peripheral speed requires an acceleration of the response of the control system to the detecting means. This is because if the aforesaid response is not sufficiently prompt relative to the peripheral speed of the rotary wheel, then the stitching line relative to the side edge will deviate, thereby failing to provide a stitching line on a work piece at a given distance from the aforesaid said edge. For this reason, even if a non-responsive zone for maintaining the rotary wheel in an inoperable condition is provided in the detecting means, the width of the zone appears as a control error for the position of the side edge, due to the high responsiveness of the control device and the increased peripheral speed of the rotary wheel. For this reason, the width of the zone can not be enlarged sufficiently for obtaining a desired stitching line with the result that the frequency of changing the direction of rotation of the servomotor for driving the rotary wheel is greatly increased, thereby causing a large current flow, thereby shortening the service life of the servomotor, causing a problem in its durability.

Secondly, as has been described earlier, the desired control of the side edge of a work piece over a wide range dictates an increase in peripheral speed and high responsiveness. In an attempt to attain the aforesaid object by rotating the rotary wheel either in the normal direction or in the reverse direction, the following shortcomings arise. As shown in FIG. 13A, the rotary wheel should operate in response to the side edge a of a work piece W, even if the rotary wheel fails to respond to a frayed spot b produced on the side edge a, when the work piece is cut. Conversely, when the rotary wheel can not respond to the frayed spot, then the rotary wheel cannot operate so as to control in response to the portion of the side edge where no fraying is produced. In either case, the desired stitching line c can not be achieved. In case the side edge a includes a discontinuity, such as shown in FIGS. 13B and 13C, where, for example, work pieces W are stitched together on their superposed portions d, a desired stitching line c as shown and which could be obtained manually can not be achieved.

Thirdly, when the rotary wheel is used for control by rotating it in the normal direction or reverse direction, it is difficult to provide a control system which provides a desired responsiveness relative to the peripheral speed of the rotary wheel. When the feeding speed of the work piece is increased as in the case of an industrial sewing machine or the like, or when the position of the side edge of the work piece is controlled, there is a deviation of the desired stitching line, even if the width of an non-responsible zone in the detecting means is minimized. For this reason, when the shape of the stitches, such as a fancy stitch, is of importance, then the feeding speed of the machine should be reduced, even at the sacrifice of operational efficiency, and in addition the peripheral speed of the rotary wheel should be reduced.

In addition, in the attempt wherein a work piece is given a moment of rotation about the stitching point by means of the resisting means so that the side edge of the work piece is maintained in contact with the mechanical stop mechanism for positioning the same properly, the following shortcomings arise:

Firstly, even after the side edge of the work piece has contacted the stop member, there still remains a moment of rotation acting in a direction to urge the side edge of the work piece towards the stop member, so that in the case of a soft work piece, the side edge of the work piece is buckled at the point of contact with the stop member, thereby failing to provide the desired stitching line.

Secondly, in the case of a work piece having a side edge with waves having a small radius of curvature, the moment of rotation should be increased for a convex portion, and decreased for a concave portion. However, it is quite difficult in practice to adjust the moment of rotation acting on the work piece by detecting the shape of the side edge of the work piece during the sewing operation of a machine so as to change the pressing force of the resisting device. Particularly, an excessive moment of rotation results in the buckling phenomenon at the side edge of the work piece at the position of the stop member, and thus this attempt is not practical.

For these reasons, the aforesaid attempts only find application in situations where the side edge of the work piece has a large radius of curvature and the work piece is relatively stiff.

Meanwhile, there arises a need to stitch two sheets of fabric in superposed relation, with the cutting edges of the fabrics being in alignment with each other. However, in such a case, the starting and terminating points for stitching sometimes become out of alignment, as shown in FIGS. 17B and 17C. This stems from inaccurate cutting, inaccurate feeding mechanism on the sewing machine, and undesirable shifting of fabrics due to the type of materials thereof. Sometimes, one of fabrics is cut longer than the other.

In a manual sewing operation, as shown in FIGS. 18A to 18D, the stitching past such an edge discontinuity is carried out along a smooth stitching line over a distance sufficient to take into account the discontinuity. Referring to FIGS. 18A to 18D, F indicates the direction of feed of the fabric, A is the starting point, and B the end point of such a smooth stitching line. FIG. 18A and FIG. 18C show stitches sewn by a sewing machine, and FIGS. 18B and 18D show overlock machine-stitches.

According to the prior art automatic guiding method, there are obtained stitching lines or stitches as shown by broken lines in FIGS. 19A to 19C. FIG. 19A is for the case where the work piece is forced against the mechanical stop, FIG. 19B is for the case wherein deviation of the work piece in the direction toward or away from the control line is controlled according to a signal from an edge detecting means, and FIG. 19C is for the case where only deviation of the work piece in the direction away from the control line is controlled according to a signal from the edge detecting means, while deviation of the work piece in the direction towards the control line is controlled by means of a stop.

FIGS. 19A to 19C show stitches formed in the standard condition according to the prior art methods. The letter F indicates the direction of feed of the fabric, and P and Q indicate the starting point and a terminating point of the stitches around the stepped portion. The fabric on the left side of the figures has a descending step portion, while the fabric on the right side has an ascending step as viewed from the feeding direction.

In FIGS. 19A to 19C, the positional relationship between the spacing between the control starting point P and the control terminating point Q, and the stepped portion does not vary to a large extent, when changing the shapes of elements, correcting speed, responsiveness and mutual positional relationship of the device. This can be seen easily by actually inserting fabric or by watching the shifting of fabric on the table. More particularly, the prior art attempts are ineffective for stitching of fabric having such a stepped portion. The major reason for this is the short correcting space, and is due to the fact that the control starting point corresponds with the stepped portion as can be seen from FIGS. 19A to 19C. One solution to the short correcting space is to increase a radius of curvature of the cut edge of the fabric and then reduce the maximum fabric shifting speed. However, the provision of a correcting space sufficiently large for smoothing the line of stitching requires the supply of fabric having a substantially linear edge, and thus this solution is not practical. It follows from this that the supply means should be improved so as to lower the fabric shifting speed to provide a sufficient spacing only upon detecting a stepped portion. In addition, one solution to the difficulty caused by having the control starting point at the stepped portion of the fabric is to detect the discontinuity ahead of the adjusting the position of fabric, i.e., before the discontinuity in the fabric comes to the fabric guiding means, thereby controlling the fabric guiding means or the discontinuity. With the prior art automatic guiding methods and devices for use in a sewing machine, when the cut edge of a work piece includes a discontinuity, there may be obtained stitches spaced a given distance from the contour of the edge of the fabric, so that, as shown in FIGS. 19A to C, staggered stitches are produced at the discontinuity and in the worst case, the stitches run off the fabric. Accordingly, for avoiding the aforesaid shortcomings, there should be provided an electrical, optical or other detecting means which detects a discontinuity in the fabric, before adjusting the position of the fabric. As a result, there should be provided a special means for controlling the position of fabric only at the discontinuity, and such means is costly and complex.

SUMMARY OF THE INVENTION

Accordingly, an object of the present invention is to provide an automatic guiding method and device suitable for a work piece in a sewing machine which avoids the aforesaid shortcomings in the prior art devices of this type.

It is another object of the present invention to provide an automatic guiding method and device of the type described, in which when a work piece is particularly soft, the buckling of the edge of the work piece due to the contact of the edge with an engaging surface of a stop member can be prevented.

It is still another object of the present invention to provide an automatic guiding method and device of the type described, in which even when a work piece having a discontinuity in the edge such as a stepped portion is to be stitched, the stepped portion constituting the discontinuity can be automatically compensated for, thereby providing a stitching line which runs smoothly at a desired distance from the side edge of the work piece.

According to the present invention, there is provided a detecting means which detects whether or not the side edge of a work piece is in its proper position upstream of a stitching point or whether or not the side edge is biased in a direction away from a control point (to reduce the distance from the side edge of the work piece to the stitching line), a rotary wheel which is supported in a rotatable manner about an axis substantially parallel with the feeding direction and is in contact with the work piece, is rotated in a given direction in response to a deviation signal from the detecting means. As a result, the work piece is moved until the edge of the work piece is brought to a proper control position (in a direction to increase the distance from the side edge of the work piece to the stitching line), while a mechanical stop restricts the biasing of the side edge of the work piece past the control position beyond an allowable amount. The advantages of the present invention are as follows:

(i) The rotary wheel rotates only in one direction, or is stopped. Thus, the frequency of the starting and stopping of the rotary wheel is reduced to half that of the prior art rotary wheel. In addition, because of the absence of changeover from the normal rotation to reverse rotation, the instantaneous maximum current is reduced, so that the service life of an electric motor serving as the drive for the rotary wheel can be extended with an accompanying improvement in the durability thereof. In addition, the drive for the rotary wheel can be taken from a rotating portion on the side of the sewing machine, whereby the rotation of the rotary wheel can be controlled by means of a clutch.

(ii) The rotary wheel starts rotating, only when the side edge of the work piece is biased in the direction away from the control point, so as to draw the work piece back to the control position. Even if the side edge a of the work piece has a frayed portion b or a projecting portion d, i.e., a built up discontinuity as shown in FIGS. 12A to 12C, the control system including detecting means and a rotary wheel will not respond to this, so that the presence of the frayed portion b will not affect the controlling operation, while the stop member guides the side edge a of the work piece W therealong including the discontinuity, thereby producing a smooth stitching line c as shown and such as can be obtained by manual sewing.

(iii) When the stop member is positioned properly, even if the responsiveness of the control system remains unchanged, the inertia of the load is reduced by half, so that the followability is enhanced. In addition, the rotary wheel rotates only in one direction for control, so that the followability is greatly improved and the deviation of the stitching line from the control line is minimized. Thus, a satisfactory stitching line can be obtained with a high speed sewing machine.

(iv) A work piece is not forced against the stop member all the time, so that even a soft work piece will not have buckling at the side edge thereof. In addition, the side edge of the work piece may be controlled so as to be in the proper position by means of a rotary wheel having sufficient high peripheral speed and good responsiveness, so that even a soft work piece having a side edge with a relatively small radius of curvature can be stitched in a satisfactory manner.

According to the present invention, a detecting means detects the deviation of the side edge of a work piece from the control position upstream of the stitching point, thereby producing a signal, so that the work piece can be moved in a correcting direction in response to a detecting signal in a manner so as to bring the side edge of the work piece to a control position. In addition, the deviation of the side edge of a work piece beyond an allowable amount in the direction closer to the control line can be prevented at a control point upstream of the detecting point and is restricted by means of a mechanical means. Even when a work piece being fed to a stitching point has a discontinuity therein such as a stepped portion, the work piece can be controlled by the mechanical means in such a manner that the edge of the work piece having a the discontinuity is guided towards the aforesaid control point which is spaced from the detecting means a distance sufficient for effecting the correcting operation for the stepped portion constituting the discontinuity, whereby a smooth stitching line along the discontinuity of the work piece is obtained just as in a manual sewing operation.

According to the present invention, a mechanical stop member is spaced a sufficient distance from the detecting means so as to make possible the correcting operation for a stepped portion constituting a discontinuity in the side edge of a work piece, while making unnecessary any special improvement or device.

For instance, when the step member is positioned between a stitching point and a drawing member of a feeding control device, the stop member should be located in a control position or on the side closer to a control line within an allowable amount for guiding the work piece to a proper position. However, the buckled edge which is produced results in an increase in the distance between the side edge of the work piece and the stitching point. In addition, the contacting force between the work piece and the stop member due to the aforesaid shifting to the side closer to the control point is increased in proportion to the distance of the work piece to the stitching point, so that the buckling of the edge of the work piece is increased.

Accordingly, when the step member is located further upstream of the drawing member of the feeding control device with respect to the stitching point, the contacting force between the work piece and the stop member is decreased, as compared with the above described case. In addition, when the buckled edge moves out of contact with the engaging surface of the stop member and becomes flat, the detecting means detects the deviation of the side edge toward the side away from the control point, by positioning the stop member on the side away from the control point so as to position the side edge of the work piece on the side away from the control position, whereupon the feeding control device is operated so as to draw the side edge of the work piece toward the control position, whereby the deviation of the side edge due to the presence of a buckled side edge is prevented. However, when the stop member is located to far away from the control position, the desired control of the position of the side edge of the work piece can not be achieved due to the position of the stop member, even though the force for feeding the work piece is increased. In addition, the buckling of the side edge of work piece stems from the contacting force between the work piece and the stop member, so that it is essential to increase the length along which the side edge of the work piece contacts the stop member. This causes the contacting force to be spread out, thereby reducing the tendency of the side edge of the work piece to buckle. However, this only achieves a partial success.

In addition, because the work piece engaging surface of the stop member is spaced upstream from the stitching point, the side edge of the work piece tends to shift closer to the control point due to a force acting on the work piece between the stitching point and the engaging surface of the stop member in the direction towards to the control point. For preventing this, it is essential to provide a second stop member in the control position or in a position closer to the control point between the stitching point and the drawing member of the feeding control device. In addition, when the side edge of the work piece contacts the stop member, the frictional force on the work piece is stronger when it is in a buckled condition than when it is in the flat condition, so that it is preferable to provide a clearance to flatten a buckled side edge which has been produced by the contact of the work piece with the first stop member between the engaging surface of the first stop member and the engaging surface of the second stop member. The first and second stop members may be provided separately, but may be integral with each other.

According to the present invention, the engaging surface i.e., contacting portion of the stop member is located upstream of the feeding control device with respect to the stitching point, so that even if the buckled side edge is produced at the engaging surface of the stop member, the buckled side edge becomes flattened by the time it at the detecting means, so that the side edge will be positioned on the side away from the control point or in the control position. As a result, an error in the stitching line due to a buckled side edge can be prevented.

In addition, according to the present invention, a second stop member is located between the stitching point and a drawing member of a feeding control device, for instance, in integral relation to the detecting means, whereby the shifting of the work piece to the side towards a control point in the vicinity of the detecting means more than an allowable amount due to the aforesaid shifting force can be avoided.

BRIEF DESCRIPTION OF THE DRAWINGS

FIGS. 20A to 20H are views illustrating the method according to the present invention, in which FIG. 20A shows flat side edges, and FIG. 20B to FIG. 20H show correcting operations for side edges having a stepped portion.

DESCRIPTION OF THE PREFERRED EMBODIMENTS

Figure 1:
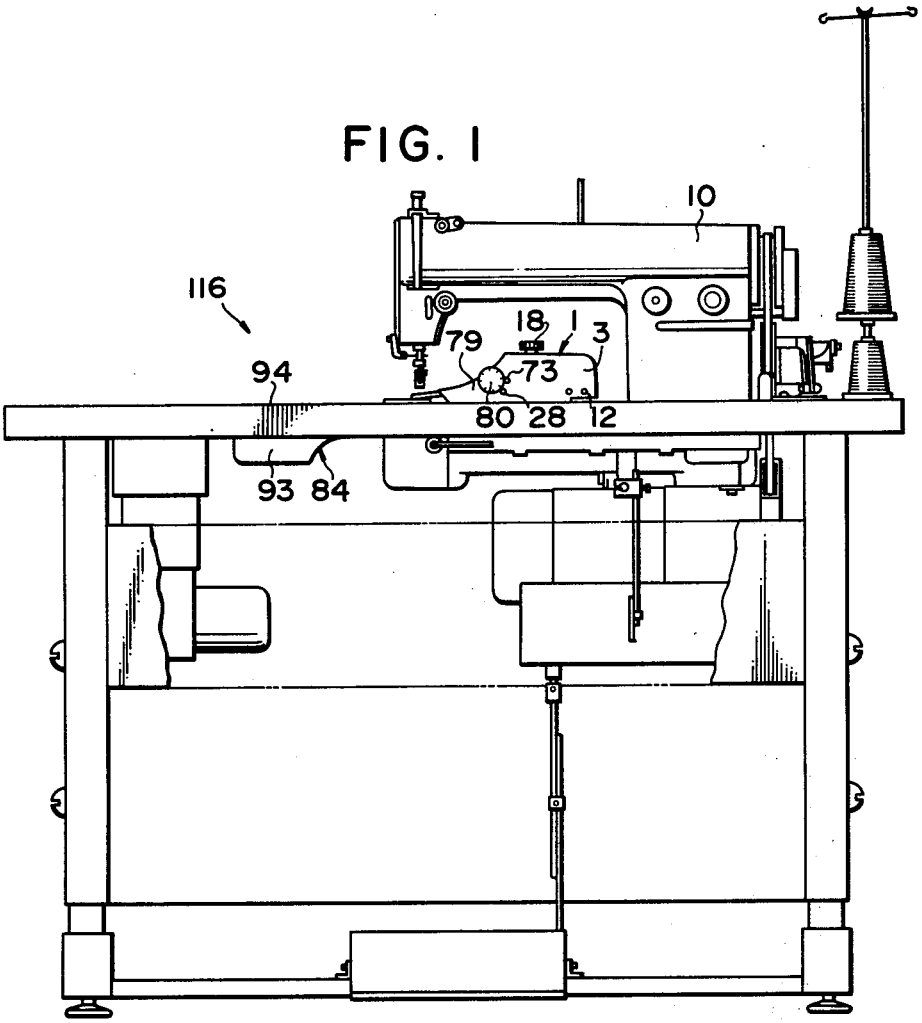
FIG. 1 is a front view of one embodiment of the automatic guiding device for a work piece according to the present invention, which is installed in an industrial sewing machine.

FIG. 1 shows an embodiment of the automatic guiding device according to the present invention which is installed in an industrial sewing machine of a known type. However, the guiding device according to the present invention can also be used in an overlock sewing machine, high speed sewing machine and the like.

Figure 2:
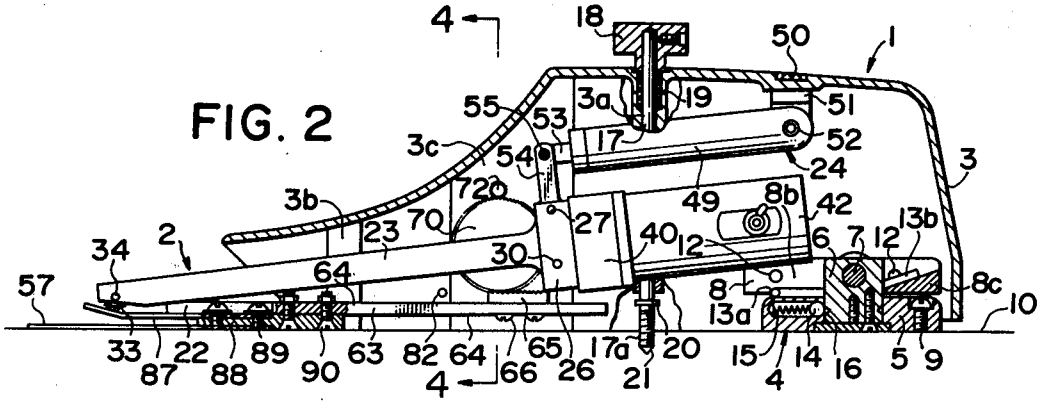
FIG. 2 is a longitudinal cross-sectional view, on an enlarged scale, showing the interior of the automatic guiding device of FIG. 1.
Figure 3:
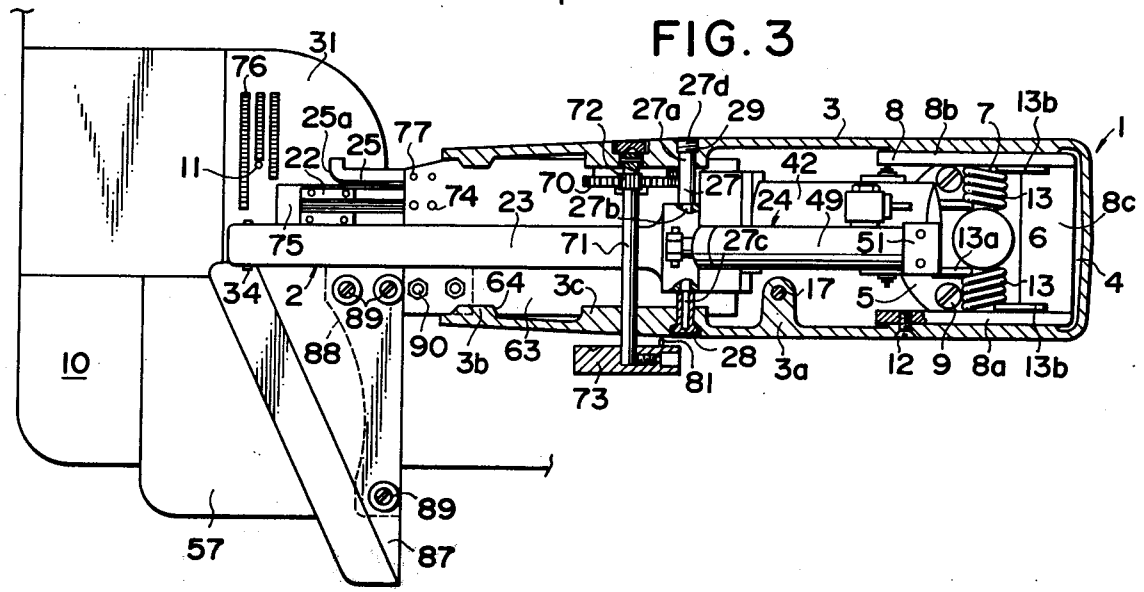
FIG. 3 is a cross-sectional plan view of the device shown in FIG. 2.

As shown in FIGS. 2 and 3, the automatic guiding device 1 consists of: a stop member 88 which mechanically prevents the side edge of the work piece from being biased toward a control point beyond an allowable amount (to the right in the drawing); a detecting means 22 adapted to detect the side edge of the work piece during the sewing operation and to issue a signal only when the side edge is biased away from the control point (to the left in the drawing); a cover member 3 equipped with a feeding control means 2 adapted to draw the work piece toward the control point, until the side edge of the work piece comes to a given control position, in response to a signal from the detecting means 22; and an attaching member 4 positioned on the base of the cover member 3.

The attaching member 4 is comprised of a vertical mount 5, a turning shaft 6 which is rotatably mounted in the center portion of the mount 5, and an attaching seat 8 which is rotatably supported for rotation in the vertical direction by the turning shaft 6 through the medium of a shaft 7. The mount 5 is fastened to the body proper 10 of a sewing machine by means of screws 9, so that the attaching member 4 is located properly, relative to a needle position 11 on the body 10. On the other hand, the cover member is removably attached to the attaching seat 8 on the attaching member 4 by means of a screw 12 in its lower edge, so that the cover member 3 can be vertically rotated about the shaft 7 as well as horizontally around the center of the mount 5 on the turning shaft 6.

The attaching seat 8 in the attaching member 4 consists **8*c* connecting the lower edges of the portions 8*a* and 8*b* while the vertical plate portions 8*a* and 8*b* are supported on the turning shaft 6 substantially at the centers thereof on the shaft 7, of vertical plate portions 8*a*, 8*b* and horizontal plate portion thereby permitting rotation in the vertical direction above the turning shaft 6. Springs 13 are mounted on the shaft 7 on both ends thereof, and one end 13*a* of each spring 13 8 to the turning shaft 6. One end 13*a* of the spring 13 presses against the surface of the mount 5, while the other end 13*b* presses against the top surface of the horizontal plate member 8*c* of the attaching seat 8. Thus, the attaching seat 8 and the cover member 3 attached thereto can be maintained in an inclined raised position relative to mount 5 by being rotated about the shaft 7**, due to the biasing force of the springs 13. Provided in the mount 5 in the attaching member 4 are a ball 14 and a spring 15 forcing the ball against the surface of the turning shaft 6. Two recesses 16 are provided in the surface of the turning shaft 6 for selectively receiving the ball 14. Thus, due to the engagement of the ball 14 in the recesses 16 during the rotation of the turning shaft 6, the shaft 6 is in click stop engagement with the mount 5.

As shown in FIG. 2, the cover member 3 is provided with a guide member 3*a* integral therewith, while a setting rod 17 extends slidably through the guide portion 3*a* in a vertical porition. The setting rod has a grip portion 18 at its top, and a coil spring 19 is confined between the grip portion 18 and the cover member 8. Due to the biasing force of the coil spring 19, the setting rod 17 is maintained in its raised position where a snap ring 20 fitted on the lower portion of the setting rod 17 abuts the undersurface of the guide member 3*a*. Thus, the cover member 3 can be rotated between an operating position wherein one of the recesses 16 in the turning shaft 6 in the attaching member 4 receives the ball 14 in the side of the mount 5, and a rest position wherein the other recess 16 receives the ball 14. This permits the shifting of the automatic guiding device 1 to the rest position for carrying out a manual sewing operation. For an automatic sewing operation, the cover member 3 is returned to the operating position and the grip portion 18 is depressed and rotated so as to cause a threaded portion 17*a* on the lower end portion of the setting rod 17 to be threaded into a threaded hole 21 provided in the body proper of the machine, whereupon the front portion of the automatic guiding device 1 is depressed against the force of the springs 13 and is fixed in position.

Figures 4, 5:
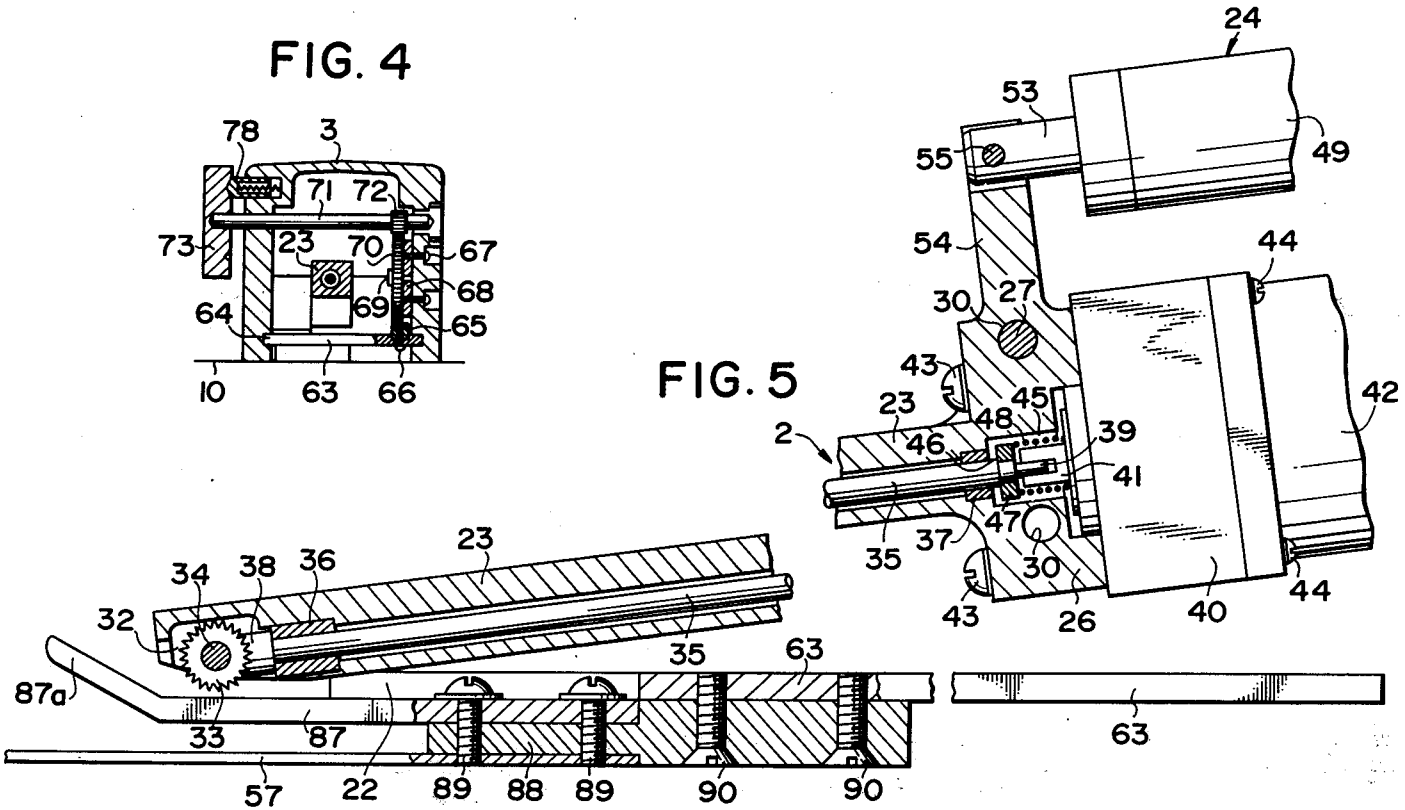
FIG. 4 is a transverse cross-sectional view taken along the line 4—4 of FIG. 2.
FIG. 5 is a broken, enlarged longitudinal cross-sectional view of an arm portion of the automatic guiding device.

The feeding control means 2 provided in the cover member 3 essentially comprises an arm 23 having a large supporting block portion 26 at the base portion of the arm 23. A shaft 27 extends through the supporting block portion 26, so that the block portion 26 can be rotated in a vertical plane relative to the cover member 3. The shaft 27 supporting the arm 23 consists, as shown in FIG. 3, of a large diameter portion 27*a*, a medium size diameter portion 27*b* and a small diameter portion 27*c*, i.e., three stepped portions, and the the smaller diameter portion 27*c* is rotatable in a bearing 28 which has been press-fitted in the cover member 3. A threaded portion 27*d* on the large diameter portion 27*a* is threaded into a threaded hole 29 in the side of the cover member 3, and that the supporting block 26 of the arm 23 is pivotally supported on the medium size diameter portion 27*b* of the shaft 27. In this embodiment, two transverse holes 30 are provided in upper and lower positions in the supporting block 26 of the arm 23 for accommodating the medium size diameter portion 27*b* of the shaft 27. Two threaded holes 29 and two bearings 28 are provided in the cover member 3 corresponding with the respective transverse holes 30. The shaft 27 can be inserted in other of the holes 30 thereby supporting the supporting block portion 26 of the arm 23 for pivoting in the vertical direction. The arm 23 extends slants downwards to the left from the supporting block portion 26, with the tip of the arm 23 extending beyond the needle position of the body proper 10 of the machine in vertically spaced opposed relation to the throat plate 31. As is best shown in FIG. 5, a recess 32 opening out of the undersurface of the arm 23 is provided in the tip portion of the arm 23. A rotary toothed wheel 33 shaped like a pinion is positioned within the recess 32, with its lower portion projecting below the undersurface of the arm 23. The rotary wheel 33 is rotatably supported on a shaft 34 running substantially parallel with the feeding direction of the work piece. A transmission shaft 35 extends through the arm 23 along the axis thereof for imparting rotation to the rotary wheel 33, and are journaled in bearings 36 and 37. A face gear 38 attached to the end of the transmission shaft 35 meshes with the rotary wheel 33. The other end portion of the transmission shaft 35 is coupled through the medium of a tongue-and-groove joint 39 to a shaft 41 of a reduction gear 40 which in turn is coupled to an electric motor 42. The reduction gear 40 is attached to the supporting block portion 26 of the arm 23 by means of screws 43, while the electric motor 42 is affixed to the reduction gear 40 by means of screws 44. Thus, the rotation of the electric motor 42 is transmitted from the reduction gear 40 through the transmission shaft 35 and face gear 38 to the rotary wheel 33, thereby rotating the rotary wheel 33 about the shaft 34. In this case, for maintaining positive meshing of the face gear 38 with the rotary wheel 33, a hole 45 having a large diameter is provided in the supporting block portion of the arm 23 extending in the axial direction. The other end of the transmission shaft 35 is positioned in the hole 45, and a thrust bearing 47 against a shoulder portion 46 thereon. A coil spring 48 is confined between the thrust bearing 47 and the front end of the reduction gear 40, thereby urging the transmission shaft 35 to the left. An operating member 24 is provided for causing the arm 23 to effect a pivotal movement about the shaft 27. The operating member 24 consists of an air cylinder 49 in this embodiment, and its base portion is rotatably coupled to a bracket 51 affixed to the upper inner surface of the cover member 3 by means of a screw 50, while the tip of a piston rod 53 is hinged to the top of a connecting arm 54 extending upwardly from the supporting block portion 26 of the aforesaid arm 23. The piston rod 53 of the air cylinder 49 remains in the retracted position due to the biasing action of a spring (not shown) housed therein, thus causing the rotary wheel on the arm 23 to be spaced upwardly from the surface of the body proper 10 of the machine, so that the work piece can be placed under the rotary wheel 33. During a control operation, compressed air is supplied into the air cylinder 49 for moving the piston rod 53 of the air cylinder 49 to its extended position, so that the arm 23 is rotated in the counterclockwise direction about the shaft 27 for forcing the rotary wheel 33 on its tip against a surface of a work piece. As a result, the work piece will be held between the rotary wheel 33 and the surface of the body proper 10 of the machine. Thus, when an instruction is given to the electric motor 42 to rotate the rotary wheel 33 in the counterclockwise direction, then the rotary wheel 33 will shift the work piece to toward the control point, i.e., to the right.

In addition, a retaining plate 63 is slidably mounted on the cover member 3. The retaining plate 63 extends slidably through a groove 64 defined by projecting portions 3*b* and 3*c* integral with the inner side surfaces of the cover member 3, and extends parallel with the arm 23 in the horizontal direction, and the tip portion of the retaining plate 63 outwardly beyond the tip of the cover member 3 and can be shifted into and out of the cover member 3. As shown in FIGS. 3 to 5, a rack 65 is attached to the inner end of the retaining plate 63 by means of screws 66. The rack 65 meshes with a gear 70 rotatably supported on the bracket 68 on a shaft 69, the aforesaid bracket 68 being affixed to the cover member 3 by means of a screw 67. In addition, the gear 70 meshes with a pinion 72 on the end of a shaft 71 extending through and rotatably mounted in the cover member 3, and the other end of the shaft 71 is provided with a grip portion 73. When the grip portion 73 is rotated, the rotation is transmitted from the shaft 71 through the pinion 72, to the gear 70. Due to the rotation of the gear 70, the retaining plate 63 is shifted into or out of the cover member 3 along the rack 65.

Figure 6:
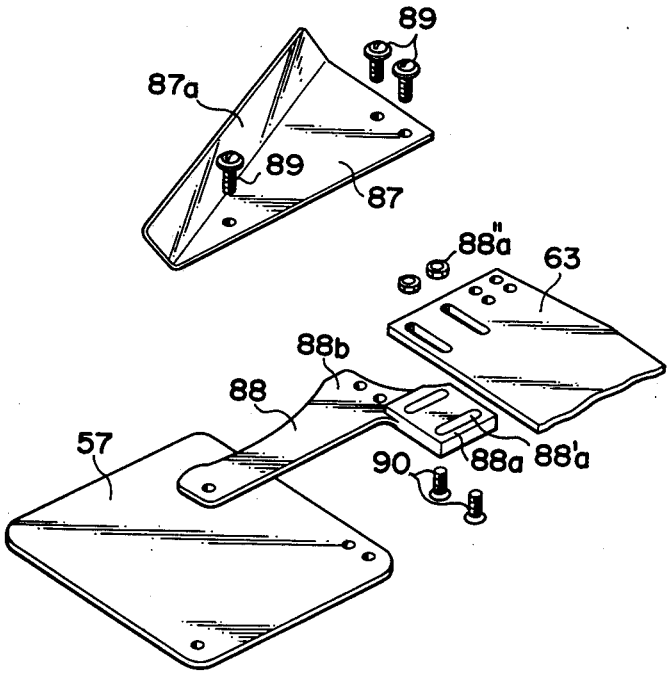
FIG. 6 is an exploded, perspective view of a stop member and its associated parts.

A stop member 88 is provided for mechanically preventing the side edge of the work piece from being moved toward the control point more than an allowable amount during the sewing operation. As shown in FIG. 6, the stop member 88 consists of a flat plate portion **88*b* and an attaching portion 88*a* having two slots 88'*a*, through and a bolt 90 extends each of the slots. As shown in FIGS. 2 and 3, the stop member 88 is positioned upstream of the arm 23 forming part of the feeding control means 2 and is attached to the undersurface of the outer end of the retaining plate 63 by the pair of bolts 90 and nuts 88''*a* threaded thereon. The undersurface of the stop member 88 contacts the surface of the body proper 10 of the machine, when the automatic guiding means 1 is set in its operating position. The outer end of the flat plate member 88*b* of the stop member 88 prevents the side edge of a work piece from being biased towards the control point beyond an allowable amount when the work piece is fed between the surface of the body proper 10 of the machine and the rotary wheel 33 in the feeding control device 2 in a given direction by means of a feeding mechanism 76 in the body proper of a machine. If the work piece is relatively soft, then the edge of the work piece may buckle or fold over when urged against the stop member 88, or move into the clearance between the undersurface of the stop member 88 and the surface of the body proper 10 of the machine, thereby impairing the desired function of the stop member 88. In such a case, as shown in FIGS. 2 and 3, it is preferable that a holding plate 87 and a bottom plate 57 be attached to the stop member so that they extend leftward from the and bottom surfaces of the stop member. In other words, the upper holding plate 87 prevents a work piece from being folded over by means of the stop member 88, when urged against the latter, and hence may be a flat plate having a triangular shape, as shown in FIG. 6, and in addition the upper holding plate 87 can have the left-hand edge 87*a* bent angularly upwardly for facilitating the positioning of the work piece against the undersurface thereof. In addition, the lower bottom plate 57 prevents the work piece from creeping under the undersurface of the stop member 88, and is a square flat sheet as shown in FIG. 6. The holding plate 87 and the bottom plate 57 are secured to the top and bottom surfaces of the flat plate portion 88*b* of the stop member 88 by means of screws 89, and the work piece is positioned between the holding plate 87 and the bottom plate 57. Thus, the folding over and ingress of a work piece under the undersurface of the stop member 88 is positively prevented. Accordingly, the stop member 88 can function even with a soft work piece. The shape of the stop member 88 is not necessarily be limited to the shape shown in this embodiment. The stop member 88** may have any other suitable shape, or may be a pin.

Figure 7:
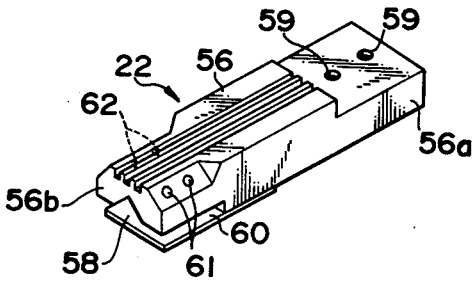
FIG. 7 is a perspective view of a detecting means.

The detecting means 22 for detecting the position of the side edge of the work piece during the sewing operation consists of a holder 56 as shown in FIG. 7, and a reflecting plate 58 secured to the undersurface of the outer end portion thereof by means of a screw (not shown). The holder 56 is provided with with attaching holes 59 in its inner end portion **56*a*, with the outer end portion 56*b* being spaced a distance 60 from the reflecting plate 58**.

The surface of the holder 56 which is opposed to the reflecting plate 58 has a 'V' shaped recess, and two sets of luminous diodes 61 and photo transistors 62 are provided in the holder 56 so as to be exposed thereto. The detecting means 22 is positioned between the needle position 11 on the body proper 10 of the machine and the arm 23 in the feeding control means 2, as shown in FIG. 3, and is secured to the tip end of the retaining plate 63 by means of screw 74 through holes 59 provided in the portion **56*a* of the holder 56. In this case, for facilitating the positioning of the work piece, the detecting member 22 is positioned with the top surface of the reflecting plate 58 flush with the surface of the throat plate 31, by inserting the reflecting plate 58 into a cut-away portion 75 provided in the throat plate 31, when the automatic guiding means 1 is in its operating position, by screwing the setting rod 17 on the cover member 3 into the threaded hole 21 in the body proper 10 of the machine. However, when the setting rod 17 is unscrewed from the threaded hole 21, the front side of the cover member 3 is raised due to the biasing force of the spring 13, whereupon the reflecting plate 58 is drawn out of the cut-away portion 75 provided in the throat plate 31. Thus, when the automatic guiding means 1 is shifted back to its rest portion, the reflecting plate 58 will be prevented from jamming in the cut-away portion 75** in the throat plate.

The luminous diode 61 and photo transistor 62 which are positioned in the outer end of the detecting means 22 detect the end of the work piece, and are maintained over the work piece during the sewing operation all the times when the work piece passes thereunder, thereby providing a terminating signal the sewing machine. In contrast thereto, the luminous diode 61 and photo transistor 62 provided toward the inner end detect the side edge of the work piece, and detect the deviation of the side edge, only when the side edge of the work piece moves in the direction away from the control position, i.e., to the left, thus providing a rotation signal to the electric motor 42 in the feeding control means 2, with the result that, as has been described earlier, the rotary wheel 33 is rotated in the counterclockwise direction so as to draw the work piece back towards the control point, i.e., to the right, after which, when the side edge of the work piece is returned to its proper position, the rotation signal is interrupted so as to stop the electric motor 42.

Thus, the work piece is first positioned between the holding plate and the bottom plate 57 in the stop member 88, under the rotary wheel 33 at the end of the arm 23 in the feeding control means 2, as well as in the clearance 60 defined between the holder 36 and the reflecting plate 58 in the detecting means 22, and then a starting signal is given to the machine. Then, compressed air is supplied to the air cylinder 49, which is the operating member 24 for the arm 23 in the feeding control means 2, thereby holding the work piece between the rotary wheel 33 and the surface of the throat plate 31 in the body proper 10 of a machine. Then, the work piece is fed in the direction towards the needle position 11 by means of the feeding mechanism 76 in the body proper 10 of a machine, while maintaining the above condition.

In this case, however, for positioning the work piece properly, there is provided a positioning piece 25 beside the detecting means 22. As shown in FIG. 3, the positioning piece 25 is made of a block member having an arcuate surface 25*a* at its outer end, while the inner end thereof is secured to the outer end of the retaining plate 63 by means of screws 77. Accordingly, the work piece can be set in a proper position by inserting the side edge against the outer end of the positioning piece 25. The side edge of the work piece is prevented from being biased towards the control point, i.e., to the right, by the stop member 88, while the deviation of the side edge of the work piece in the direction away from the control point, i.e., to the left, is corrected by the cooperative operation of the combination of the detecting means 22 with the rotary wheel 33 in the feeding control means 2. Thus, the work piece will be supplied to the stitching point, with the side edge thereof maintained in the proper controlled position.

In this manner, the work piece can be automatically stitched along a given line parallel with the side edge thereof, leaving a given spacing or margin therefrom.

In carrying out a control operation, if the stop member 88 is positioned somewhat to the left of the side edge control position of the work piece, the side edge of a work piece is biased to the left from the control position at all times, so that the detecting means 22 detects the position of the side edge as being to the left of the control position, thereby operating the rotary wheel 33 during the supply of the work piece to the stitching point, with the result that the control characteristic can be further improved. In addition, the rotary wheel 33 is rotated in only one direction, including the time when the operating is stopped, so that the rotary wheel 33 can be driven from a rotating means in the body proper 10 of the machine through an operating mechanism such as a clutch which is intermittently controlled by the detecting means 22, thereby making it possible to dispense with the electric motor 42.

The size of the margin produced during a sewing operation depends on the distance between the detecting element on the inner side of the detecting means 22 and the needle position 11 on the body proper 10 of the machine, so that the size of the margin can be varied by shifting the retaining plate, detecting means 22 and stop member 88 by rotating the grip portion 73 on the cover member 3. In this embodiment, for controlling the position of the detecting means 22 relative to the needle position 11 to obtain the desired margin, there is provided a click mechanism 78 between the cover member 3 and the grip member 73, and an index 79 and graduations 80 (see FIG. 1) are provided on the surfaces of the cover member 3 and grip member 73 at the respective click positions of the click mechanism 78. On the other hand, a pin 81 is mounted on the back surface of the grip member 73 for limiting the rotational angle of the grip member 73 to a given range (which will maintain the rack 65 in meshing relation with the gear 70) by abutting the aforesaid click mechanism 78. In addition, a margin setting hole 82 (FIG. 2) is provided in the cover member 3 in the path of to the rack 65 of the retaining plate 63. The retaining plate 63 can be drawn forwards, until the tip of the rack 65 is blocked by a member (not shown) which has been inserted into the hole 82, thereby limiting the movement of the retaining plate 63. Thereafter, the grip member 73 is fixed so that the minimum value of the graduations 80 is in alignment with the index 79 on the cover member 3, after which the member is withdrawn from the hole 82. Thus, when the gear ratio of the pinion 72 to the rack 65 is so selected that the distance from the inner detecting element in the detecting means 22 to the needle position 11 on the body proper of the machine corresponds to the graduation 80 on the grip member 73, then the size of the margin can be set, from the graduation 80 on the grip member 73.

Figure 8:
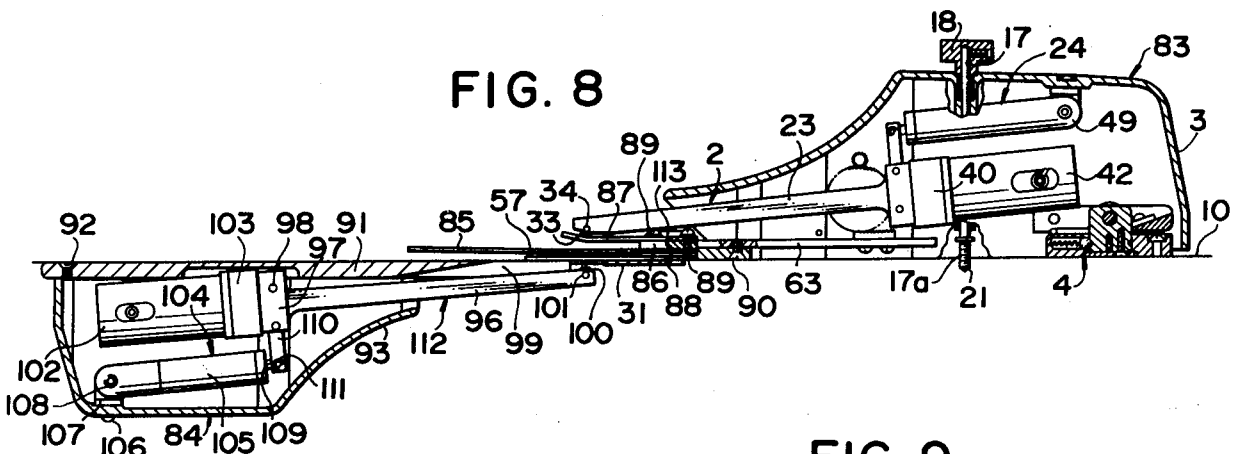
FIG. 8 is a longitudinal cross-sectional view of a second embodiment of the automatic guiding device according to the present invention, which is used for controlling the side edges of upper and lower work pieces individually.

The description thus far has been for an automatic control for the position of the side edge single sheet of a work piece. However, the positions of two superposed work pieces can be automatically controlled. As shown in FIG. 8, there are provided upper and lower automatic guiding means 83 and 84 for automatically guiding the work pieces in such a case.

In the upper automatic guiding means 83, the stop member 88 and bottom plate 57 as described in the preceding embodiment are used for the lower work piece, while the holding plate 78 is used for the upper work piece. In addition, a separating plate 85 and a stop member 86 for the upper work piece are interposed therebetween, and a detecting means 113 is provided to detect the side edges of the upper and lower work pieces, independently. Except for the above points, the second embodiment is fundamentally similar to the first embodiment of the automatic guiding means 1. Accordingly, the description will be limited to differences between the two embodiments, using like reference numerals.

Figure 10:
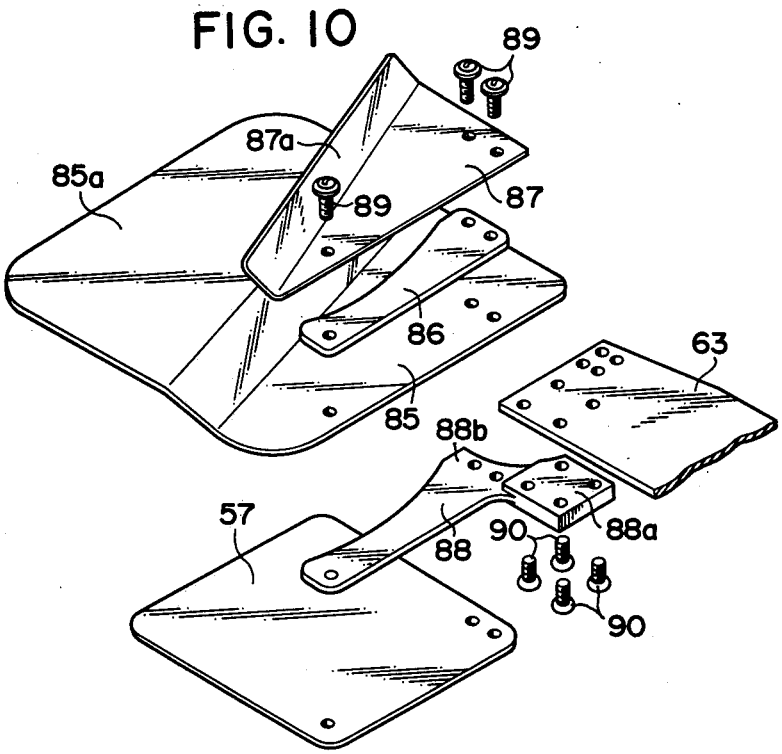
FIG. 10 is a perspective view of a stop member and its associated parts for use in the automatic guiding device shown in FIGS. 9 and 10.

As shown in FIG. 10, the lower stop member 88 having a bottom plate 57 is affixed to the undersurface of the outer end portion of the retaining plate 63, while a separating plate 85, an upper stop member 86 and the holding plate 87 for preventing the folding over of a work piece are superposed in this order on the plate portion 88*b* of the lower stop member 88 and secured thereto by means of screws 89. The aforesaid separating plate 85 separates the two work pieces in the vertical direction and serves to prevent the folding over of the lower work piece. For this reason, the separating plate 85 has a square shape, and extends along the surface of the body proper 10 of the machine, with part of the plate 85 being opposed to the rotary wheel 33 at the end of the arm in the feeding control means 2. The upper stop member 86 has the same shape as that of the plate portion 88*b* of the lower stop member 88. The two work pieces are positioned between the holding plate 87 and the bottom plate 57, with the separating plate 85 being therebetween. In this case, a portion of the separating plate 85, which is opposed to the left edge 87*a* of the holding plate 87, is bent into a shape "⌄", i.e., has an angled portion in the middle, so that the lefthand portion 85*a* is somewhat higher than the righthand portion.

Figure 11:
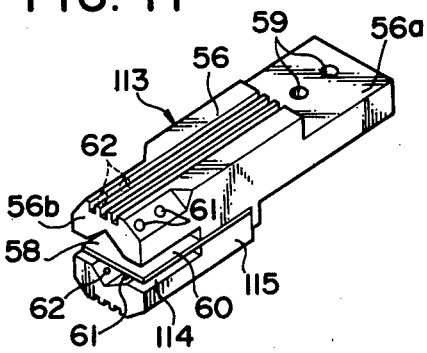
FIG. 11 is a perspective view showing one example of the detecting device used in the automatic guiding device shown in FIGS. 9 and 10.
Figure 13A:
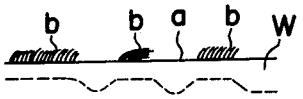
FIGS. 13A to 13C are views showing a stitching line in a sewing operation according to the prior art.
Figure 12A:
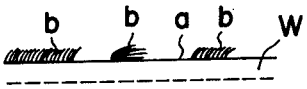
FIGS. 12A to 12C are explanatory views showing a stitching line in a sewing operation according to the present invention.
Figure 13B:
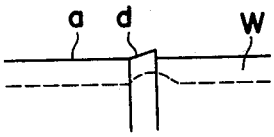
Figure 12B:
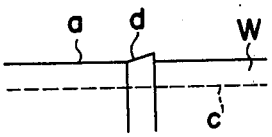
Figure 13C:
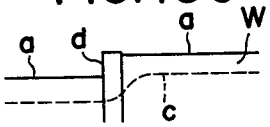
Figure 12C:
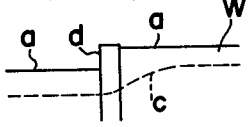

As shown in FIG. 11, the detecting means 113 includes a lower holder 115 secured to the outer end portion of the holder 56 by means of screws not shown, with a clearance 114 provided between the reflecting plate 58 and the holder 115, but on the opposite side from the holder 56. In addition, the surface of the lower holder 115 which faces the reflecting plate 58 has a 'V' shaped groove, as in the case of the upper holder 56, with luminous diodes 61 and phototransistors 62 being positioned therein so as to be exposed into the aforesaid 'V' shaped groove, the aforesaid luminous diodes and photo transistors serving for detecting the position of the side edge of the work piece and the terminal position of the work piece, respectively. The detecting member 113 is attached to the tip of the holding plate 63 by means of screws 74, while part of the lower holder 115 is fitted in a cut-away portion 75 provided in the throat plate 31 on the body proper 10 of the machine. When upper and lower work pieces are positioned in the clearances 60 and 114 in the detecting member 113, and then the upper and lower work pieces are fed in a given direction through the feeding mechanism 76 in the body proper 10 of the machine, the detecting elements on the inner part of the upper and lower holders 56 and 115 in the detecting member 113 detect the positions of the side edges of respective work pieces, independently.

Figure 9:
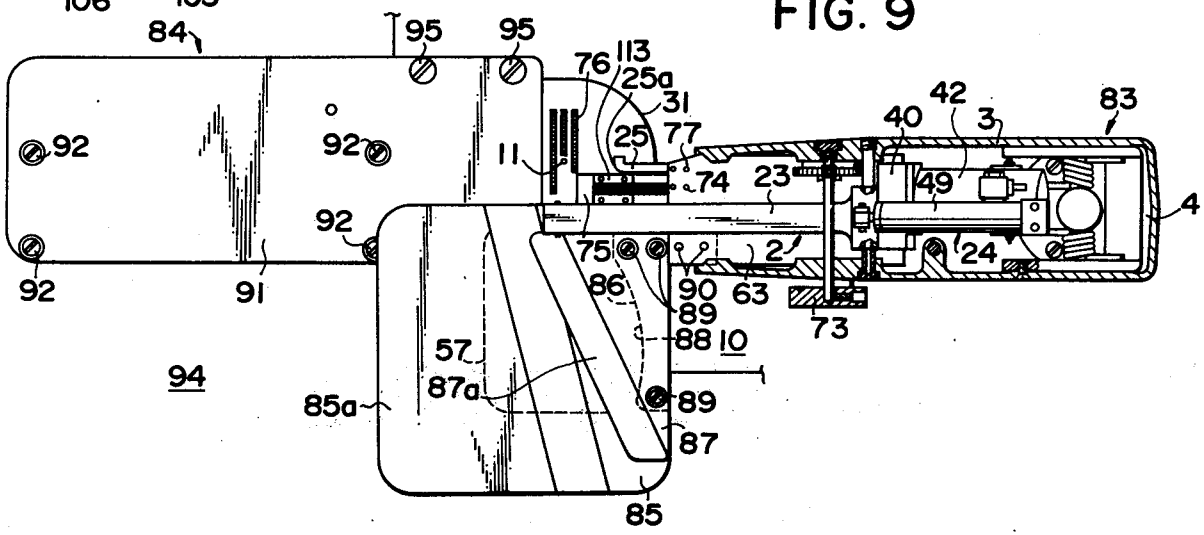
FIG. 9 is a sectional plan view, partly broken away, of the automatic guiding device of FIG. 8.

The lower automatic guiding means 84, as best shown in FIGS. 8 and 9, having a cover member 93 is removably attached to a fixing plate 91 serving as a corner plate of the body proper 10 of the machine by means of screws 92, and the cover member 93 is fitted in a cut-away portion provided in a table 94 on the body proper 10 of the machine, and the fixing plate 91 is secured to the body proper 10 by means of screws 95 in a manner such that the surface of the fixing plate 91 is flush with the top surface of the table 94, so that the lower guiding means 84 is positioned below the table 94 in symmetric relation to the upper automatic guiding means 83. The arm 96, which is a portion of the feeding control means 112 in the lower automatic guiding means 84, is the same as the arm 23 on the upper automatic guiding means 83, and is pivotally supported by the cover member 93, with its supporting block portion 97 being supported on the cover member 93 on the shaft 98. The supporting block portion 97 can also be selectively supported either at its upper or lower portion by means of a shaft 98. The arm 96 extends from the supporting block portion upwardly to the right, with the free end thereof being exposed through a hole 99 through the fixing plate 91 and throat plate 31. A rotary wheel 100 is rotatably supported on the top surface of the free end of the arm 96 by means of shaft 101, with the rotary wheel 100 being opposed to the rotary wheel 33 on the upper automatic guiding means 83 on the other side of the separating plate 85 therebetween. Although a detailed description is not necessary, it is pointed out that rotary wheel 100 is rotated around a shaft 101 running substantially parallel with the feeding direction of the work piece through a reduction gear 103 driven by an electric motor 102 secured to the supporting block portion 97. As is apparent from FIG. 8, an air cylinder 105 serving as an operating member 104 for the arm 96 is rotatably supported on a bracket 107 by means of a shaft 108, the aforesaid bracket 107 being attached to the cover member 93 by means of a screw 106. On the other hand, a piston rod 109 in the air cylinder 105 is hinged to the end of a connecting arm 110 depending from the supporting block portion 97 by means of a shaft 111.

Respective air cylinders 49 and 105 in the upper and lower automatic guiding means 83 and 84 remain in their retracted positions under the biasing actions of springs (not shown) therein, while maintaining the rotary wheels 33 and 100 on the side ends of arms 23 and 96 in a spaced, symmetric relation to each other on opposite sides of the separating plate 85, as shown in FIG. 8. Upper and lower work pieces are position of between the upper rotary wheel 33 and the lower rotary wheel 100, with the separating plate 85 being positioned therebetween. During the controlling operation, compressed air is supplied to the air cylinders 49 and 115, respectively, for moving them to their extended positions for forcing rotary wheels 33 and 100 on the arms 23 and 96 against the separating plate 85, in a manner such that the upper and lower work pieces are positioned between the rotary wheels 33 and 100 and separating plate 85.

In this case as well, the stop members 86 and 88 prevent the side edges of the upper and lower work pieces from being biased towards the control point, i.e., to the right. When the work pieces are biased to the left, then detecting means 113 detects the deviations of the work pieces respectively, whereby rotary wheels 33 and 100 corresponding thereto can be rotated independently for bringing the side edges of work pieces to the control positions. In this manner, the upper and lower work pieces can be switched, with the side edges thereof being in alignment with each other, and a desired margin formed thereon.

As is apparent from the foregoing, according to the present invention, the positions of the side edges of work pieces can be automatically controlled by using rotary wheels 33 and 100 adapted to rotate only in one direction, including the time when the operation thereof is stopped, during the sewing operation. Thus, the present invention avoids the shortcomings experienced with the prior art devices of this type, thereby providing desired stitching lines for work pieces having a wide range of side edge contours.

FIGS. 14A to 14D show the positional relationship between the mechanical stop member and its associated parts in the automatic guiding means according to the present invention.

Figure 14A:
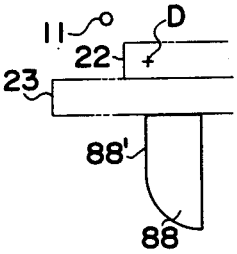
FIGS. 14A to 14D are views showing the positional relationship between the stop member and its associated parts according to the present invention.

As shown in FIG. 14A, there is provided upstream of the stitching point 11 detecting means 22 adapted to detect the deviation of the side edge of a work piece only when the side edge of the work piece is moved in the direction away from the control point D (to the left of the control point). In addition, a drawing member 23 in a work piece feeding control means, which is adapted to draw the side edge of the work piece back to the control point D, in response to a signal from the aforesaid detecting means, is positioned upstream of the detecting means 22. Furthermore, a contacting portion 88' of a mechanical stop member 88 adapted to prevent the side edge of the work piece from being moved towards the control point beyond an allowable amount (to the right of the control point) is positioned further upstream of the drawing member 23 from the stitching point in the feeding control means.

A work piece to be stitced is fed towards the stitching point 11, while deviation of the side edge thereof towards the control point is prevented by means of the contacting portion 88' of the stop member 88. A work piece which is particularly soft is urged against the stop member due to the force drawing the work piece towards the control point, so that the side edge of the work piece is turned over or wrinkled at the contacting portion 88'. This turned over portion of the side edge of the work piece moves out of contact with the contracting portion 88' as the work piece continues to move and then becomes flat until it arrives at the detecting means 22. Accordingly, if the side edge of the work piece thus flattened is moved away from the control point, then detecting means 22 as well as the feeding control means 2 are operated so as to draw the side edge of the work piece towards the control point D, thereby maintaining an accurate margin which corresponds to the distance between the stitching point 11 and the control point D.

According to the present invention, even if the side edge of the work piece is turned over, the turned over portion can be corrected due to the unique arrangement, thereby preventing error in the margin arising from the aforesaid turned over portion.

In FIG. 14A, if the contacting portion 88' of the stop member 88 is moved somewhat in the direction away from the control point laterally toward a line through the stitching point and parallel to the direction of feed, then the side edge of the work piece is moved in the same direction away from the control point, so that the detecting means as well as the feeding control means will be operated positively.

Meanwhile, it is preferable that the length of the contacting portion 88' of the stop member be increased for a soft work piece.

Figure 14B:
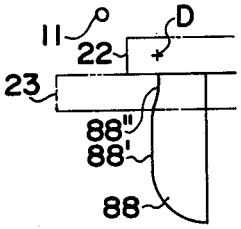

As shown in FIG. 14B, a contacting portion 88" is provided on the stop member 88 which extends laterally past the position of the feeding control means in a direction toward the stich position, thereby preventing the side edge of a work piece from moving in the direction towards the control point immediately upstream of the detecting means 22.

As shown in FIG. 14B, the contacting portion 88" is positioned at the control position D or inclined somewhat toward the control point in the direction away from the stitch position, while the contacting portion 88' is positioned somewhat laterally away from the control point in the direction toward the stitch point.

Figure 14C:
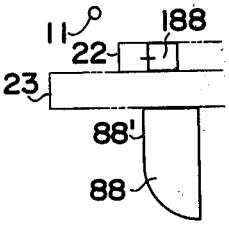

As shown in FIG. 14C, a second stop member 188 is provided between the stitching point 11 and the feeding control means 2 in the direction of the feed of the work piece. The second stop member 188 is positioned at the control point or somewhat moved towards the control point, thereby preventing the side edge of a work piece from being moved towards the control point, immediately upstream of the stitching point 11. In this figure, the contacting portion 88' of the first stopper member 88 may be spaced laterally somewhat in the direction away from the control point toward the stitch point. In addition, the first stop member 88 can be integral with the second stop member 188.

Figure 14D:
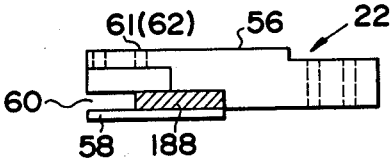

FIG. 14D shows the cross section of a detecting means 22 integral with the second stop member 188. The second stop member 188 is positioned in the clearance 60 between the holder 56 and the reflecting plate 58. The second stop 188 can be integral with or separate from the holder 56.

The shapes of the stop members shown in FIGS. 14A to 14D are only presented as examples, and hence the present invention is by no means limited to these instances. The stop member can have any shape and construction, as long as it limits the movement of the work piece.

Figure 15A:
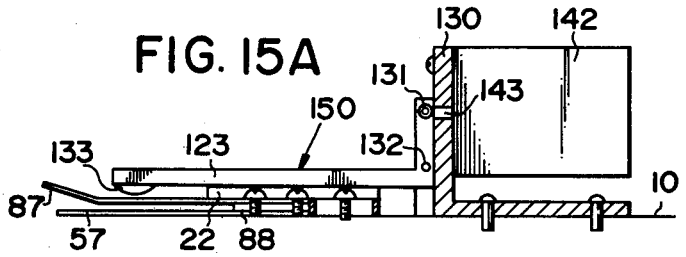
FIGS. 15A and 15B are cross-sectional and plan views of another automatic guiding device according to the present invention.
Figure 15B:
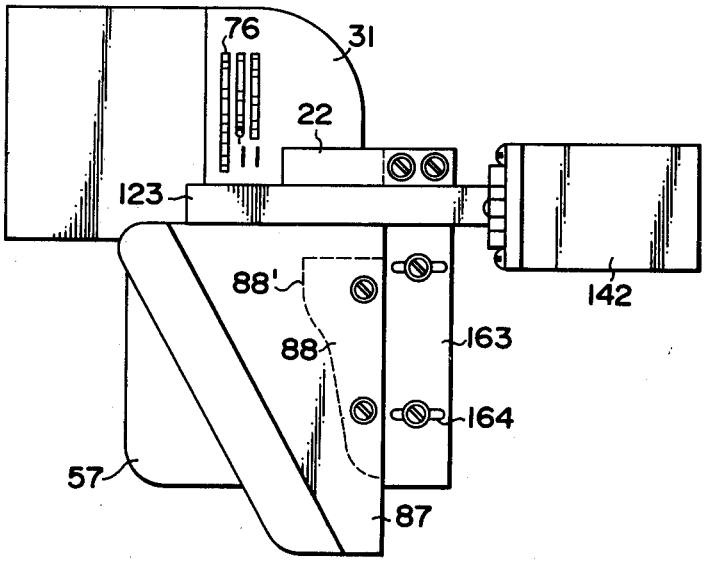

FIGS. 15A and 15B show modifications of the aforesaid work-piece feeding means shown in FIGS. 7 and 8.

The work-piece feeding control means 150 shown in FIGS. 15A and 15B consists of an air cylinder or a solenoid 142 attached to a sewing machine 10 by a mount 130, and an arm 123 having one end coupled to a plunger 143 of the solenoid 142 by means of a pin 131, and the other end of which extends towards the throat plate 31. The arm 123 is pivoted on the mount 130 by means of a pin 132, and thus may pivotally moved up and down in a vertical plane in response to the extension and retraction of the solenoid plunger 143.

When the side edge of a work piece which is being fed between the holding plate and the bottom plate towards the stitching point 11 by means of a feeding mechanism 76 in a sewing machine is moved in the direction away from the control point at the point of the detecting means 22, then the detecting means 22 detects the deviation of the side edge of a work piece, and controls the solenoid 142 energize according to a signal from the detecting means, so the plunger 143 is extended. As a result, the arm 123 is moved downwards, thereby forcing the pivot 133 provided at the free end thereof against the work piece on the left side of the center of the feeding mechnism 76. Thus, the side edge of a work piece will be drawn towards the control point, i.e., to the right in FIG. 15B.

Figure 16A:
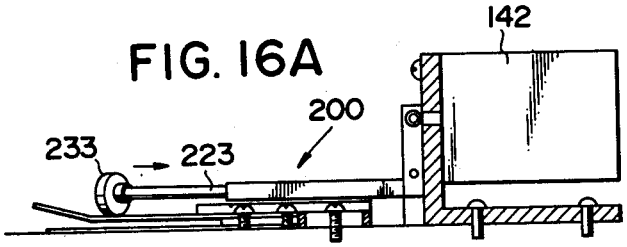
FIGS. 16A and 16B are a cross sectional view and a plan view of still another embodiment of an automatic guiding device according to the present invention.
Figure 16B:
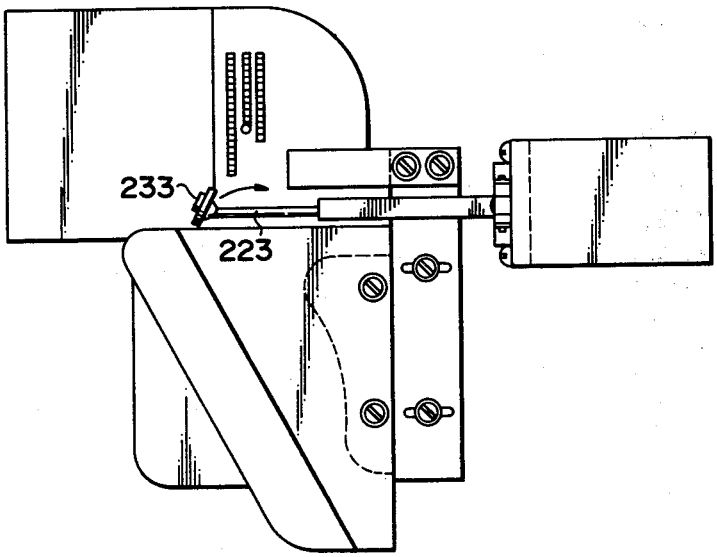
Figure 17A:
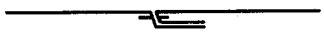
FIGS. 17A to 17C are a cross-sectional view, plan view and back view of a work piece showing the side edge stitched.
Figure 17B:
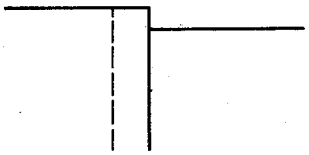
Figure 17C:
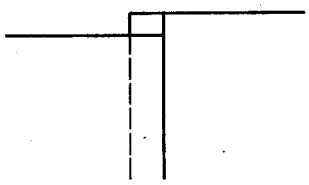
Figure 18A:
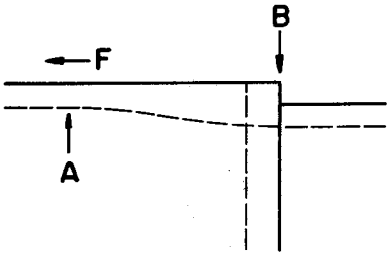
FIGS. 18A to 18D are views showing stitches and a cutting line on a work piece as shown in FIGS. 17A to 17C, produced by a manual operation.
Figure 18B:
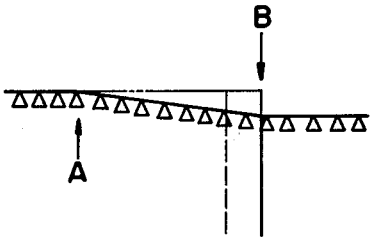
Figure 18C:
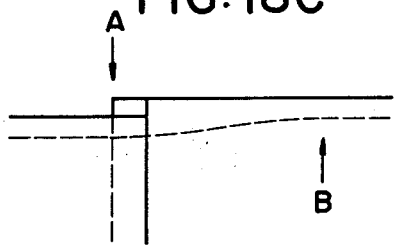
Figure 18D:
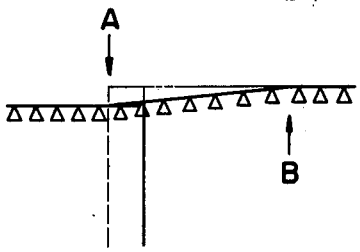
Figure 19A:
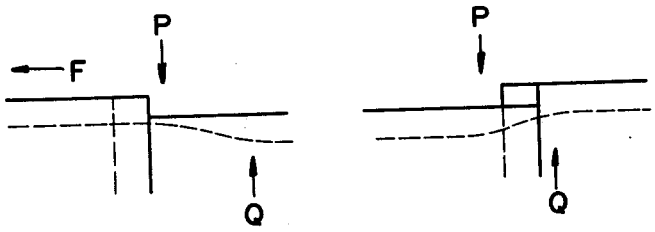
FIGS. 19A to 19C are views showing the stitches formed on a work piece according to the prior art.
Figure 19B:
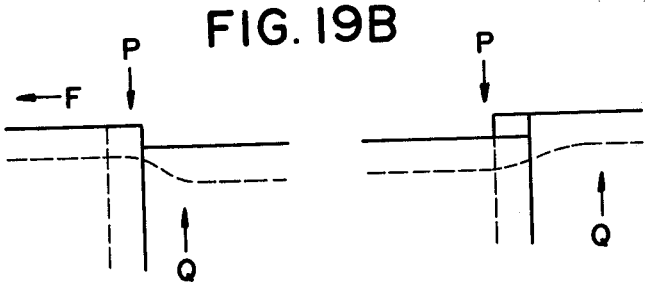
Figure 19C:
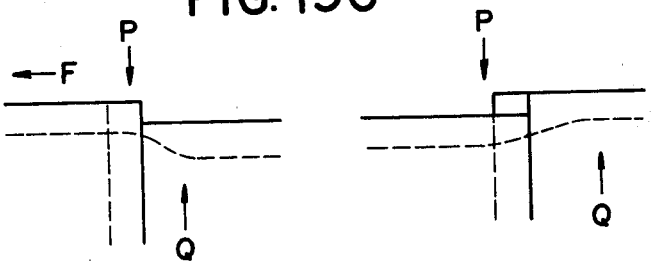

FIGS. 16A and 16B show a further modification of the work piece feeding control means. A work piece feeding control means 200 has the same construction as that shown in FIGS. 15A and 15B, except for a rotary wheel 233 attached to the free end of the arm 223.

The rotary wheel 233 is attached to the free end of the arm at a given angle to the feeding direction of a work piece so as to be rotated in the clockwise direction when engaged with the work piece being fed. When the arm 223 is pivotally moved downwards due to the energization of the solenoid 142, so that the rotary wheel 232 is urged against the work piece, then the work piece is drawn in the direction of the arrow in FIG. 16A.

As shown in FIGS. 15A, 15B, 16A and 16B, the detecting means 22 is secured to a guide block 163 by means of a plurality of screws, while the guide block 163 is secured to the sewing table by elongated holes 164 and screws therethrough so as to be adjustable in the transverse direction. In addition, the stop member 88 is secured to the guide block 163 by means of screws. Accordingly, the contacting portion 88' of the stop member may be adjusted in a direction at a right angle to the feeding direction of the work piece. thereby, the stop member can be set in the desired position with respect to the control position.

Figure 20A:
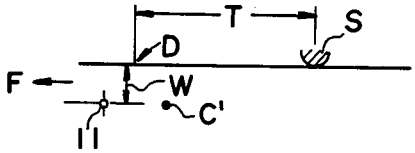

FIG. 20A shows the manner in which a work piece having a side edge free from any discontinuity is guided. In this figure, F is the direction of movement of the work piece which is being fed, the stitching point is at 11, the detecting point is at D, the margin is W, and the contact point with the stop member which is spaced upstream from the detecting point is at S, i.e., the limiting point, and the point of action of the automatic guiding means on the work piece is at C', which is positioned between the detecting point D and the limiting point S. The method of guiding the side edge of the work piece can be readily understood from the description of the automatic guiding means in the preceding embodiments.

FIGS. 20B to 20H show the method of guiding the work piece having two types of discontinuities as shown, in an automatic guiding means of the type described.

Figure 20B:
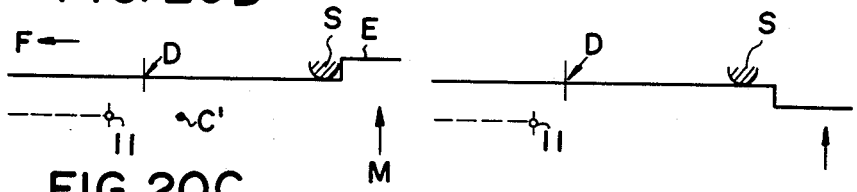
Figure 20C:
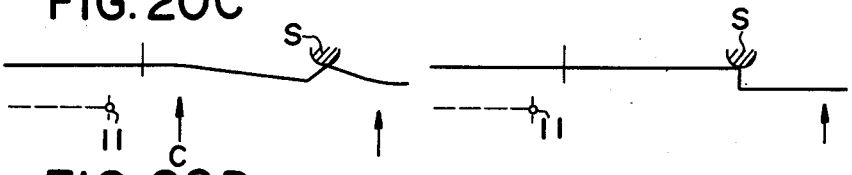
Figure 20D:
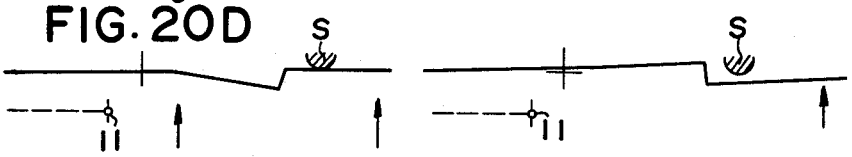
Figure 20E:
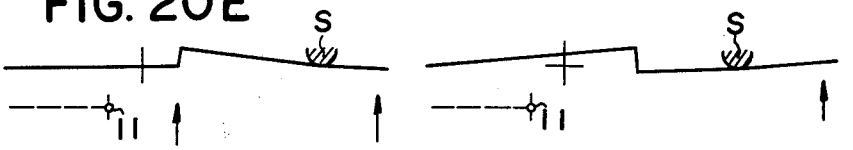
Figure 20F:
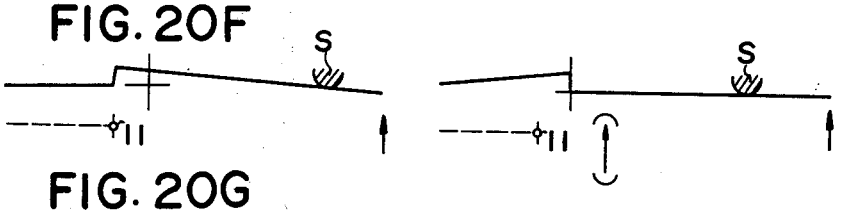
Figure 20G:
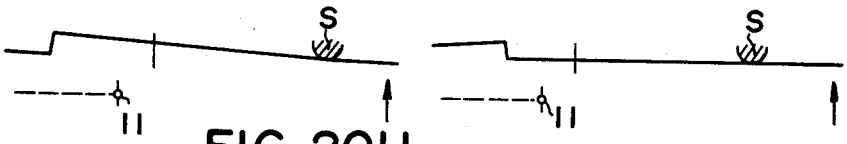
Figure 20H:
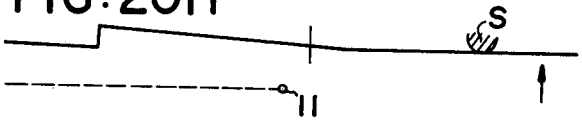

As shown at the left in FIGS. 20B to 20H, when a stepped portion projecting in the direction towards the control point hits the limiting point S, as shown in FIGS. 20B to 20C, then the stepped edge rides on the limiting point S and then the edge E contacts the limiting point S. At this time, the side edge of a work piece at the detecting point D will move away from the control point (downwards), so that the automatic guiding means is operated so as to move the edge of a work piece on the downstream side of the stepped portion toward the detecting point. Arrow C shows the direction of movement of the work piece towards the control point by means of the work piece feeding control means in the automatic guiding means. When the stepped portion passes the detecting point D, then the side edge of a work piece appears just as if the work piece has been shifted towards the control point, as shown in FIGS. 20F and 20G. Thus, the automatic guiding means remains in its rest condition, until the side edge of the work piece advances from the position of FIG. 20F past the control point. When a stepped portion, in which the side edge of a work piece is stepped in the direction towards the stitching line as shown to the right in FIGS. 20A to 20H passes the limiting points, as shown in FIG. 20C, then the work piece is moved so as to hit the limiting point according to the phenomenon to be described later. In other words, since the side edge of a work piece is not moved away from the detecting point toward the stitching line until it reaches the condition of FIG. 20F, the work piece guiding means will not be operated.

The aforesaid feeding process smoothes the stitching line as in the manual operation. The extent of smoothing, i.e., the amount over which the spacing is to be corrected, substantially corresponds to the spacing between the detecting point D and the limiting point S, as best shown in FIGS. 20A to 20H, so that the space needed for correction should be determined commensurate with the difference between the two adjoining edges in the stepped portion. In other words, the larger the aforesaid difference, the greater should be the distance over which smoothing takes place, and hence the spacing of the points D and S should be so selected that satisfactory smoothing can be achieved for the maximum size of the stepped portion in the edge of the work piece. If the limiting point is too far from the stitching point and detecting point, then the desired stitching can not be obtained for a side edge having a stepped portion and a small radius of curvature. In such a case, it is essential avoid to bringing the limiting point too close for achieving a smooth stitching line.

According to the present invention, even if the side edge of a work piece being fed towards the stitching point 11 between the detecting point D and the limiting point S has a discontinuity such as a stepped portion, with the limiting point S being spaced upstream from the acting point C', a spacing T sufficiently large for correcting for the stepped portion caused by the discontinuity should be provided. As a result, the space for correcting becomes larger than in the prior art device, and the controlling operation is commenced at a point spaced a distance T from the stepped portion of the work piece. According to the present invention, the distance between the detecting point and the limiting point, i.e., the space for correcting is set according to the size of the stepped portion in the edge of the work piece, so that the device according to the present invention can cope with work pieces having stepped portions of varying sizes.

When a work piece is fed by the work piece feeding mechanism, the feeding portion is positioned close to the side edge of the work piece, relative to the width of the work piece, with the result that friction occurs between the work piece and the table, between one work piece and another and between the work piece and other members, in addition to drooping of the work piece from the table or deviation of the work piece in the direction towards the control point. In other words, the work piece impinges on the stop member. If a portion of a work piece which is not to be sewn is fed by means of an air table, conveyor or the like in the feeding direction, and deviation of the work piece from the control point is not anticipated at all, then one of the various known work piece feeding methods can be used. Otherwise, if the work piece guiding means maintains contact with the work piece with a suitable friction all the time, then the contacting portion of the work piece feeding mechanism, i.e., the part which acts on the work piece can be biased towards the control point from the center of the work piece feeding mechanism in a manner to insure a force sufficient to draw the work piece feeding mechanism. In this respect, the force needed to shift the work piece towards the control point is small as compared with the controlling force on the work piece, and the influence on the control of the position of a work piece can be neglected.

It should be understood that the present invention may be modified and altered by those skilled in the art without departing from the scope of the present invention.

What is claimed is:

1. A method of automatically guiding a work piece in a sewing machine, comprising the steps of:

detecting the deviation of the position of the side edge of a work piece from a control position only when the side edge moves in a direction toward the line of stitching in the sewing machine, said detection being effected at a point prior to the stitching point relative to the direction of feed of the work piece;

moving said work piece transversely of the stitch line back toward the control position in response to the detected deviation until said side edge of the work piece is brought back to said control position; and blocking the movement of the side edge of said work piece from said control position in the direction transversely away from the stitch line at a point prior to of the stitching point relative to the direction of the feed of the work piece by applying a force to the edge of the work piece at a point spaced laterally of the control point toward the stitching line, the detection of deviation from said control point being detected sufficiently close to said blocking point so that the edge of the work piece is always detected as being deviated from the control point, whereby the step of moving the work piece back toward the control point is carried out constantly, and the work piece is supplied to the stitching point with the side edge of the work piece maintained in the control position.

2. A method of automatically guiding a work piece in a sewing machine, comprising the steps of:

continuously detecting minor deviations of the position of the side edge of a work piece from a control position only when the side edge moves in a direction toward the line of stitching in the sewing machine, said detection being effected at a point prior to the stitching point relative to the direction of feed of the work piece;

moving said work piece transversely of the stitch line back toward the control position by contacting a rotary wheel with the surface of the work piece and driving the rotary wheel in response to a detected deviation in a direction and for a time until said side edge of the work piece is brought back to said control position; and blocking the movement of the side edge of said work piece from said control position in the direction transversely away from the stitch line at a point prior to the stitching point relative to the direction of feed of the work piece;

whereby the work piece is supplied to the stitching point with the side edge of the work piece maintained in the control position.

3. A method as claimed in claim 2 in which said point at which the blocking step is performed is spaced from the detecting point prior to the stitching point relative to the direction of feed of the work piece, the distance between the detecting point and the blocking point being larger than the distance between the stitching point and detecting point.

* * * * *